US006672699B1

(12) United States Patent
Jeong

(10) Patent No.: US 6,672,699 B1
(45) Date of Patent: Jan. 6, 2004

(54) APPARATUS FOR DETERMINING CARTRIDGE TYPE OF PRINTER USING MICRO INJECTING DEVICE

(75) Inventor: Woo-Young Jeong, Kyonggi-do (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 24 days.

(21) Appl. No.: 09/659,565

(22) Filed: Sep. 11, 2000

(30) Foreign Application Priority Data

Sep. 13, 1999 (KR) ..... 1999-38927

(51) Int. Cl.[7] ..... B41J 29/393

(52) U.S. Cl. ..... 347/19; 347/19; 347/49; 347/50

(58) Field of Search ..... 347/19, 49, 87, 347/50; 399/12; 400/703, 175

(56) References Cited

U.S. PATENT DOCUMENTS 4,396,923 A * 8/1983 Noda ..... 346/76
4,716,421 A * 12/1987 Ozawa et al. ..... 347/43
4,872,027 A * 10/1989 Buskirk et al. ..... 347/19
5,959,645 A * 9/1999 Gondek ..... 347/43
6,151,046 A * 11/2000 Abe et al. ..... 347/50
6,161,915 A * 12/2000 Bolash et al. ..... 347/19
6,360,174 B1 * 3/2002 Shoki ..... 702/55

OTHER PUBLICATIONS

Gibilisco Stan, The Illustrated Dictinary of Electronics, 1997, Mc Graw–Hill, vol. 7, p. 70 and 141.*

* cited by examiner

*Primary Examiner*—Stephen D. Meier
*Assistant Examiner*—Ly T Tran
(74) *Attorney, Agent, or Firm*—Robert E. Bushnell, Esq.

(57) ABSTRACT

In an apparatus for determining cartridge type using micro injecting device, when various types of cartridges are mounted in a printer, the cartridge type is determined using a contact structure of the cartridge and a contact-state sensing signal of a dimple part.

13 Claims, 4 Drawing Sheets

APPARATUS FOR DETERMINING CARTRIDGE TYPE OF PRINTER USING MICRO INJECTING DEVICE

CLAIM OF PRIORITY

This application makes reference to, incorporates the same herein, and claims all benefits accruing under 35 U.S.C. 119 from an application for APPARATUS FOR DETERMINING CARTRIDGE TYPE IN THE PRINTER FOR MICRO INJECTING DEVICE earlier filed in the Korean Industrial Property Office on Sep. 13$^{th}$ 1999 and there duly assigned Ser. No. 38927/1999.

BACKGROUND OF THE INVENTION

1. Field of the Invention

The present invention relates to an apparatus for determining the cartridge type of a printer, and more particularly, to an apparatus for determining the cartridge type of the printer using a micro injecting device.

2. Description of the Related Art

In general, a micro injecting device applies electric energy or heat energy to a small amount of a fluid, such as ink, an injectable solution, or gasoline; the application of energy causes a volume change so that the fluid is supplied to a desired location, such as a sheet of printing paper or to a vehicle. Inkjet printers are illustrative of such applications.

An inkjet printer using a micro injecting device is capable of embodying various colors according to selection of a cartridge, unlike a conventional dot matrix printer; it also has a reduced noise and an excellent print quality.

An inkjet printer generally includes a printer head having a nozzle of minute diameter. Such a printer head converts ink from a liquid state to a vapor state by application of an electric signal. After that, the inkjet printer squirts the ink to the outside to cause a printing operation to be performed.

In a typical inkjet printer, because the printer head is integrated with the ink cartridge, a user must replace an entire printer head assembly, in which the ink cartridge and the printer head are integrated together, when ink is exhausted.

Such an inkjet printer is designed to selectively replace various types of cartridge, such as a mono cartridge, a color cartridge, or a photo cartridge. To obtain optimum print quality, it is preferable to determine the type of cartridge used and then perform control suitable for the corresponding cartridge.

Conventionally, to determine cartridge type, a nonvolatile RAM (NVRAM), in which information as to the cartridge type is recorded, is mounted inside the cartridge. When the cartridge is mounted or a system is initialized, a central processing unit inside the inkjet printer detects information recorded in the NVRAM to determine information about the cartridge.

However, the conventional method for determining cartridge type has several problems. First, if the NVRAM is mounted in a disposable cartridge and the information about the cartridge is recorded in the NVRAM, the manufacturing cost of the cartridge rises, thereby imposing economic burden on consumers. Moreover, if the cartridge gets a shock, the NVRAM may get out of order, and then the cartridge type may not be determined correctly.

SUMMARY OF THE INVENTION

It is, therefore, an object of the present invention to provide an apparatus for determining the cartridge type of a printer using a micro injecting device. The apparatus detects a contact-state sensing signal of a dimple part, which is a power cable connection part for a cartridge. It is detected according to its contact structure being different depending on the type of cartridge, and a cable, thereby determining the cartridge type.

It is another object of the present invention to provide an apparatus for determining the cartridge type of a printer using a micro injecting device. The detection apparatus detects resistances having different resistance values and voltage divided by reference resistor value inside a central processing unit to determine type of the corresponding cartridge.

According to the present invention, the apparatus for determining the cartridge type of the printer using a micro injecting device comprises: a connection means having at least two or more cartridge type sensing contact parts, the connection means being electrically connected to each cartridge having a different contact structure dependent on the type of cartridge, and outputting different contact signals depending on the type of cartridge; and a central processing unit detecting a contact signal transmitted from the connection means, comparing the detected contact signal with a preset standard contact signal and thereby determining cartridge type.

The connection means includes a number of dimple parts corresponding to the contact parts of the cartridge and is electrically connected with the cartridge. Moreover, one of the contact parts of the cartridge is electrically connected with at least one of the remaining contact parts.

According to the present invention, the central processing unit comprises: a constant voltage regulated power supply electrically connected to one of the contact parts for sensing the cartridge type to supply preset constant voltage; a pull-up resistance connected between the constant voltage regulated power supply and one of the contact parts; and one or more contact signal input terminals electrically connected to the remaining contact parts, besides the contact part connected to the pull-up resistance, in one-to-one manner, wherein the central processing unit detects that power source provided by the constant voltage regulated power supply is supplied to at least one or more contact signal input terminals through the pull-up resistance corresponding to the contact structure of the cartridge, and determines cartridge type according to the detected signal of the contact signal input terminals.

The cartridges are divided into a mono cartridge of a single color, a color cartridge having two or more colors, and a photo cartridge.

Additionally, the printer according to the present invention comprises: a central processing unit having a constant voltage regulated power supply for supplying a preset constant voltage and a reference resistor connected to the constant voltage regulated power supply, the reference resistor having a preset resistance value; and connection means connected to the cartridge, which has a partial resistance having a different resistance value depending on the type of cartridge and an earth (ground) terminal connected to the partial resistance, the connection means electrically connecting the partial resistance of the cartridge and the reference resistor of the central processing unit in series, wherein when the cartridge and the central processing unit are electrically connected, the central processing unit detects the level of the partial voltage, which is supplied from the constant voltage regulated power supply, divided by the partial resistance of the cartridge and the reference resistance of the central processing unit, compares a level of the detected partial voltage with at least one preset reference level value and determines cartridge type according to the compared result.

According to the present invention, the central processing unit further includes an analog/digital converter for digitizing the partial reference divided by the partial reference of the cartridge and the reference resistance of the central processing unit.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components.

DETAILED DESCRIPTION OF THE PREFERRED EMBODIMENTS

Figure 1:
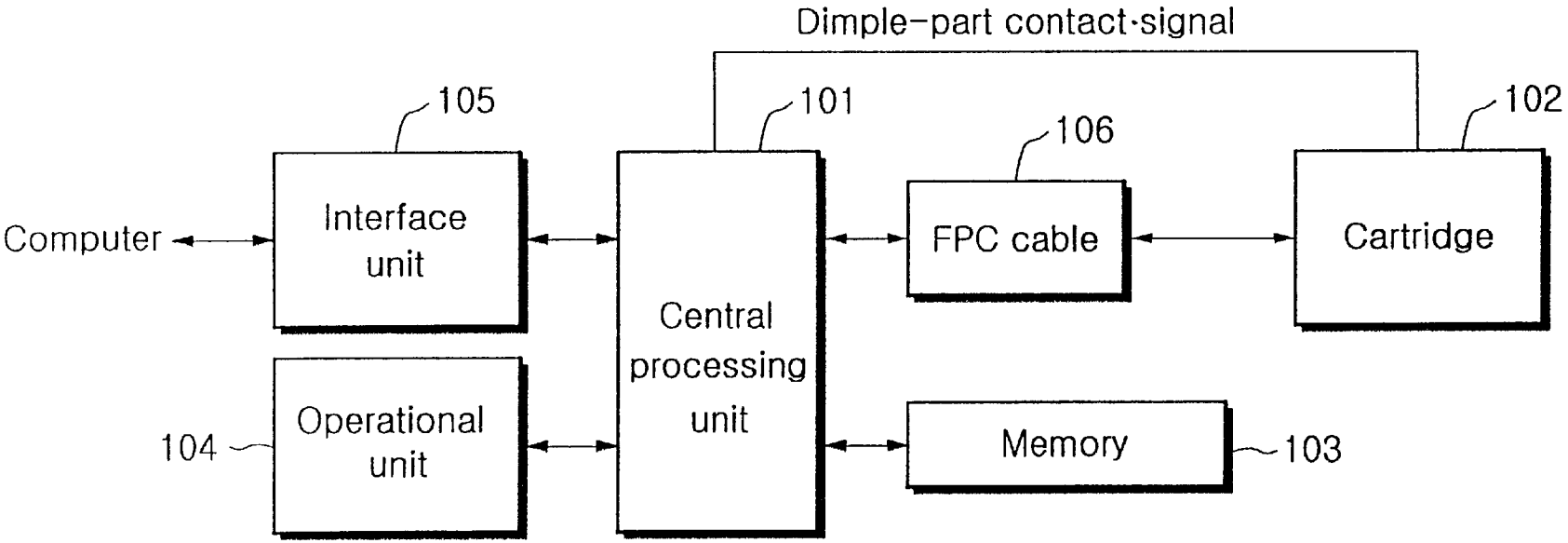
FIG. 1 is a schematic block diagram of an inkjet printer for a micro injecting device applied to a first preferred embodiment of the present invention.

The present invention will now be described in detail in connection with preferred embodiments with reference to the accompanying drawings. For reference, like reference characters designate corresponding parts throughout several views. While the present invention has been described with reference to particular components such as elements of circuit, it is obvious to those skilled in the art that the particular components are provided only to help more general understanding of the present invention and the present invention can be made Without the particular components.

Embodiment 1

Figure 2:
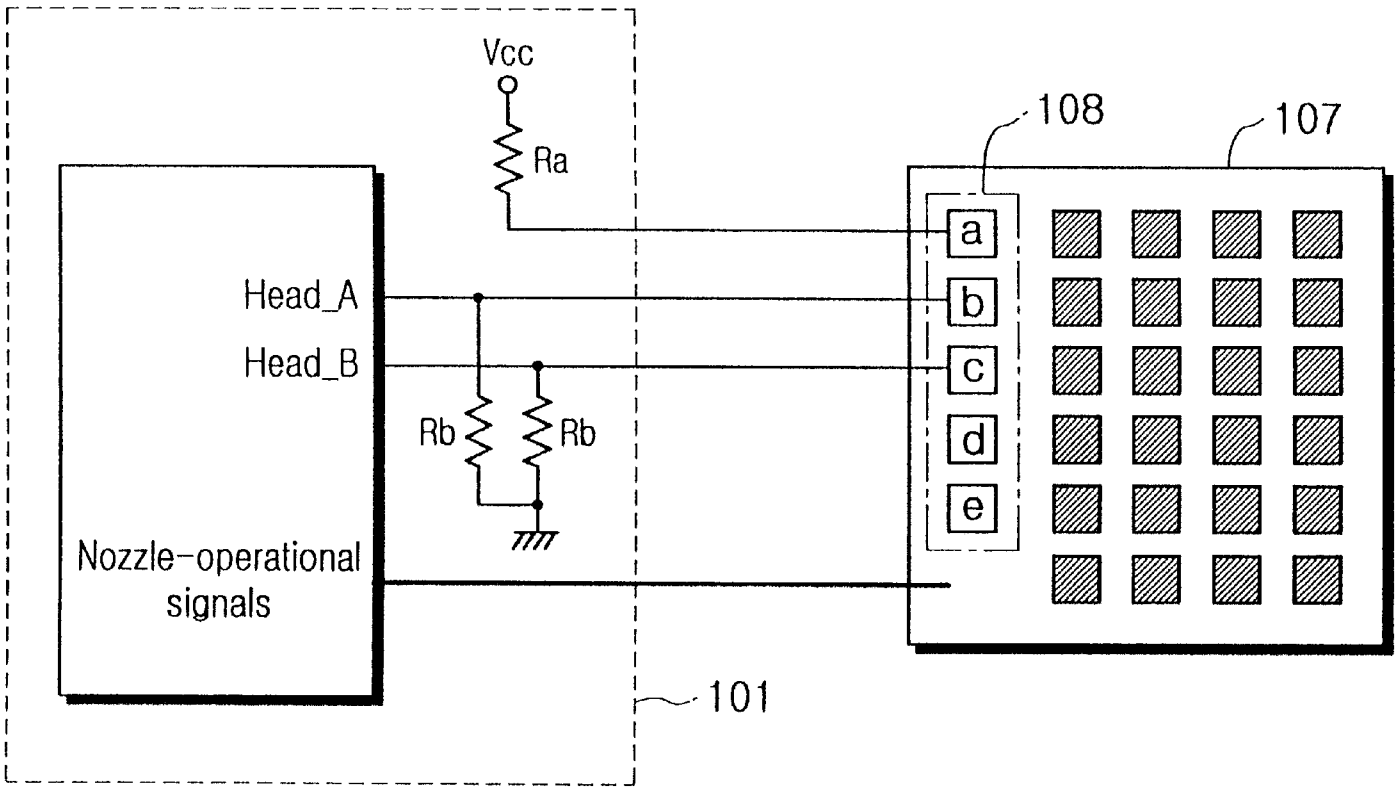
FIG. 2 is a schematic circuit diagram of a cartridge type detector according to the first embodiment of the present invention.

FIG. 1 is a schematic block diagram of an inkjet printer according to a first preferred embodiment of the present invention. FIG. 2 is a schematic circuit diagram of a cartridge type detector according to the first embodiment of the present invention. FIGS. 3*a* to 3*c* are views showing a contact structure of the cartridge according to the cartridge type used in the first embodiment and the contact: state of a dimple part corresponding to the contact structure.

Figure 3:
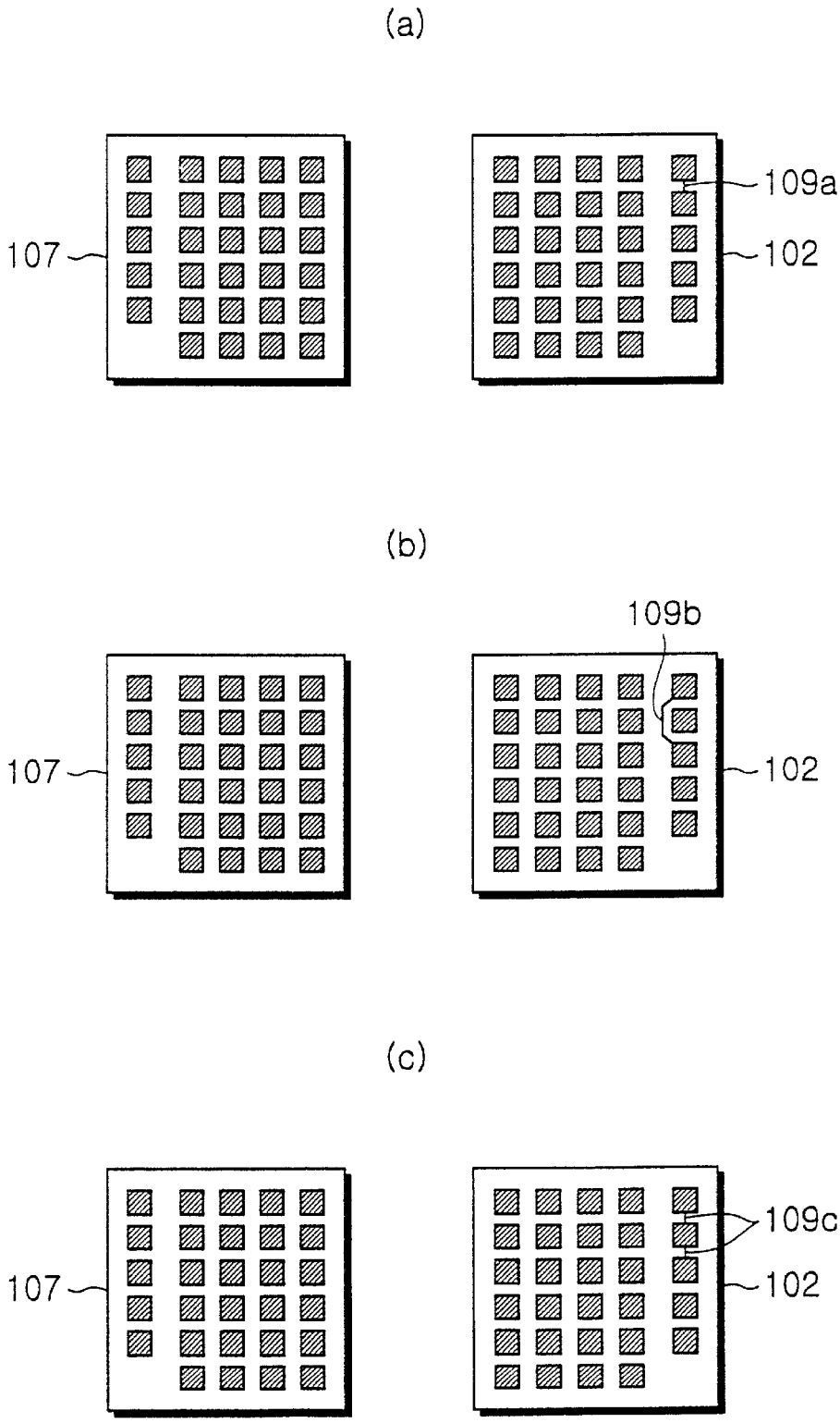
FIGS. 3*a* to 3*c* are views showing the contact structure of a cartridge depending on the cartridge type used in the first embodiment, and the contact state of a dimple part corresponding to the contact structure.

Referring to FIGS. 1 to 3, a central processing unit 101 generally controls each component block in an inkjet printer. Central processing unit (CPU) 101 determines the cartridge type by using a dimple-part contact signal detected from a dimple part of a cartridge 102 and CPU 101 performs control corresponding to the determined cartridge type. At the same time, CPU 101 controls an operation state of a nozzle of a printer head mounted in cartridge 102 depending on document data to be printed.

A memory 103 stores program and firmware to operate each component block inside the inkjet printer and temporarily stores document data, to be printed, transmitted from a computer.

An OPE (Operational Panel) 104 has a number of functional keys arranged for allowing a user to select various functions of the inkjet printer and a display window for displaying THE operation state of the inkjet printer.

An interface unit 105 is connected to the computer, interfaces the computer and the inkjet printer, and receives document data transmitted from a printer driver of the computer to transmit to CPU 101.

A FPC (Flexible Printed Circuit) cable 106 serves as a path for electrically connecting CPU 101 and cartridge 102 to transmit printing data, which is transmitted from CPU 101, and control signal, which controls the operation state of the nozzle, which corresponds to the printing data, of nozzles of the printer head mounted in cartridge 102, to cartridge 102.

Cartridge 102 is a record element for recording AN image on a printing paper and includes an ink case AND the printer head. Cartridge 102 is controlled by CPU 101 to directly inject ink to the printing paper. A contact part of cartridge 102 is in contact with dimple part 107 in different structures depending on the types of cartridge. According to the contacted form of the contact part, a discrimination circuit may detect the different dimple-part contact signal.

Here, dimple part 107 is a contact part of FPC cable 106 connected to the contact point of cartridge 102. Furthermore, FPC cable 106 has a circuit pattern in such a manner that a number of conductive metal films are longitudinally printed between a pair of heat-resistant films such as polyamide film.

A connector is connected to a side of FPC cable 106. The connector has a number of terminals corresponding to the plural conductive metal films in a one-to-one relationship to be connected to each output terminal of CPU 101. Dimple part 107, which is connected to the contact point of cartridge 102, is formed at the other side of FPC cable 106. Dimple part 107 is formed at the external surface of the heat-resistant films to be electrically connected to the contact point of cartridge 102.

Central processing unit 101 has a discrimination circuit within it for determining the type of the corresponding cartridge through the dimple-part contact signal (output signal) transmitted from cartridge 102. As shown in FIG. 2, the discrimination circuit includes a constant voltage regulated power supply for supplying a predetermined level of constant voltage Vcc. A pull-up resistance Ra is connected to a contact point (a) of a cartridge type, sensing contact part 108 in dimple part 107 and contact points (b, c, . . . ), which are connected to contact signal input terminals (Head_A, Head_B, . . . ) of CPU 101 respectively.

The operation of the first embodiment of the present invention is now described. First, the constant voltage Vcc supplied from the constant voltage regulated power supply is supplied to a contact point (a) of cartridge type sensing contact part 108 through the pull-up resistance Ra, and keeps the contact point (a) in a high state. After that, when a user mounts a given cartridge 102, contact point (a) is electrically connected to at least one contact point of the remaining contact points (b, c, . . . ) of cartridge-type sensing contact part 108.

The types of cartridge are divided into three types, a mono cartridge, a color cartridge, and a photo cartridge; they are defined as follows:

(1) The mono cartridge, as shown in FIG. 3*a*, is constructed in such a manner that the contact points of cartridge 102 corresponding to the contact points (a and b) are connected by a conductive body 109*a* to make the contact points (a and b) electrically connected.

(2) The color cartridge, as shown in FIG. 3*b*, is constructed in such a manner that the contact points of cartridge 102 corresponding to the contact points (a and c) are connected by a conductive body 109*b* to make the contact points (a and c) electrically connected.

(3) The photo cartridge, as shown in FIG. 3*c*, is constructed in such a manner that the contact points of cartridge 102 corresponding to the contact points (a, b and c) are connected by a conductive body 109*c* to make the contact points (a, b and c) electrically connected.

If the user mounts the mono cartridge, the contact points (a and b) of dimple part 107 are electrically connected through conductive body 109*a* of the cartridge 102. Therefore, the contact signal input terminal (Head_A) of the discrimination circuit is in a logic level of "high" state and the contact signal input terminal (Head B) is in a logic level of "low" state.

If the user mounts the color cartridge, the contact points (a and c) of dimple part 107 are electrically connected through conductive body 109*b* of cartridge 102. Therefore, the contact signal input terminal (Head_A) of the discrimination circuit is in a logic level of "low" state and the contact signal input terminal (Head_B) is in a logic level of "high" state.

If the user mounts the photo cartridge, the contact points (a, b and c) of dimple part 107 are electrically connected by conductive body 109*c* of cartridge 102. Therefore, the contact signal input terminal (Head_A) of the discrimination circuit is in a logic level of "high" state and the contact signal input terminal (Head_B) is also in a logic level of "high" state.

Therefore, as shown in the following Table 1, the discrimination circuit can detect the type of the mounted cartridge using the logic state of the contact signal input terminals Head_A and Head_B.

TABLE 1

| Contact state | Head_A | Head_B | Cartridge type |
|---|---|---|---|
| Contact points a and b are connected | High | Low | Mono cartridge |
| Contact points a and c are connected | Low | High | Color cartridge |
| Contact points a, b and c are connected | High | High | Photo cartridge |
| None of contact points are connected | Low | Low | There is no cartridge |

The above is restricted to the case of three cartridge types. It will be appreciated that the type of cartridge depending on the contact states may be set differently. If the number of the contact points and the number of the contact signal input terminals are increased, more types of cartridge 102 can be determined. Calculation formula of the numbers of contact points and contact signals required depending on types of cartridge 102 are as follows.

TABLE 2

| Cartridge type | Number of contact points | Number of contact signals | Calculation formula for Sensible cartridge type |
|---|---|---|---|
| 2~3 | 3 | 2 | $2^{\text{number of contact signals}} - 1$ |
| 4~7 | 4 | 3 | $2^{\text{number of contact signals}} - 1$ |
| 8~15 | 5 | 4 | $2^{\text{number of contact signals}} - 1$ |

Here, if the number of contact points is 3, one of three contact points must be connected to the constant voltage regulated power supply. Therefore, the number of sensible contact signals is 3−1=2 (which is value being one less than the number of total contact points)

Therefore, by simply converting the contact structure of cartridge 102, the cartridge type can be determined easily.

Embodiment 2

Figure 4:
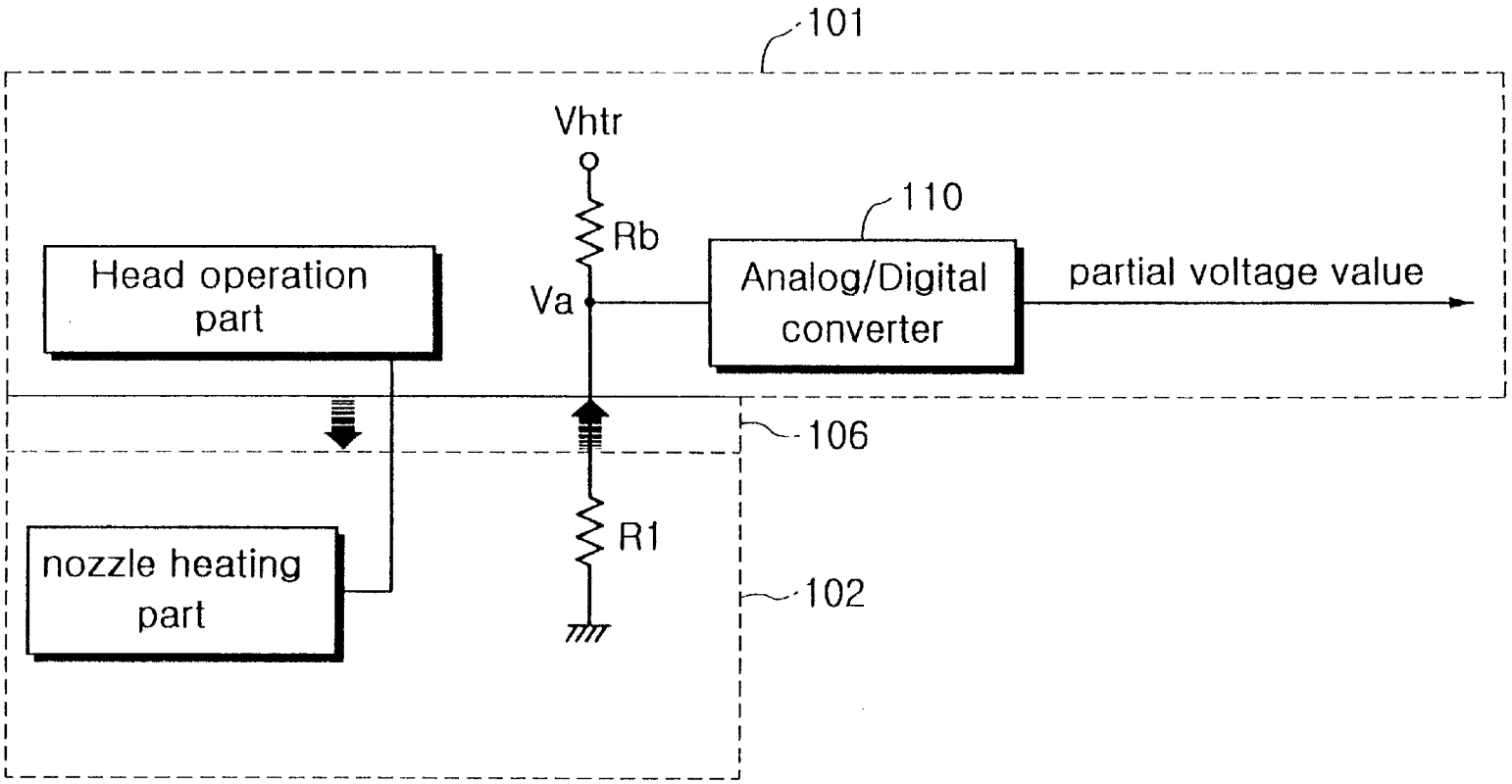
FIG. 4 is a schematic circuit diagram of a cartridge type detector according to a second preferred embodiment of the present invention.

FIG. 4 is a schematic circuit diagram of a cartridge type detector according to a second preferred embodiment of the present invention. Here, in the second preferred embodiment, as the basic construction of a printer using the micro injecting device is identical with the first preferred embodiment, the description thereof will be omitted.

As shown in FIG. 4, a cartridge type determining apparatus according to the second preferred embodiment includes a constant voltage regulated power supply for supplying a predetermined level of constant voltage Vhtr, a pair of resistances Rb and R1 connected in series between the constant voltage regulated power supply and an earth (ground) terminal, and an analog/digital converter (ADC) 110 for digitizing partial pressure voltage, which diverges between resistances Rb and R1 and is divided by resistances Rb and R1. Here, the constant voltage regulated power supply, the reference resistor Rb, and ADC 110 are disposed inside CPU 101. Partial resistance R1 and the earth terminal are disposed inside cartridge 102. When CPU 101 and cartridge 102 are electrically connected through FPC cable 106, the constant voltage regulated power supply, reference resistor Rb, partial resistance R1 and the earth (ground) terminal are connected together in series. CPU 101 detects a digital partial voltage value converted by ADC 110, compares the value with a preset value, and determines the type of cartridge 102 corresponding to the partial voltage value.

In the operation of the second preferred embodiment of the present invention, first, when the user mounts a given cartridge 102, voltage partition occurs by a pair of resistances, Rb and R1. Rb and R1 are connected in series, between the constant voltage regulated power supply and the earth (ground) terminal of cartridge 102. A voltage value of an input terminal Va input into ADC 110 is found by the following equation 1:

$$Va = Vhtr \times \frac{R1}{(R1 + R2)} \qquad \text{Equation 1}$$

where Vhtr is a constant voltage value of the constant voltage regulated power supply, Rb is a resistance value of the reference resistor mounted in central processing unit 101, R1 is a resistance value of the partial resistance, which is mounted in cartridge 102 and has different values depending on types of cartridge 102, and Va is a partial voltage which is divided between the pair of resistances Rb and R1 and is input into ADC 110. Partial voltage Va is converted nonlinearly depending on variation of the resistance value of partial resistance R1 mounted in cartridge 102.

For example, supposing that reference voltage Vhtr is 12V, reference resistor Rb is 1000Ω, the resistance value of the partial resistance mounted in the mono cartridge is 100Ω, the resistance value of the partial resistance mounted in the color cartridge is 200Ω and the resistance value of the partial resistance mounted in the photo cartridge is 330Ω, variations of the partial resistance Va are shown as the following table 3.

TABLE 3

| Partial resistance value | Calculation formula of partial voltage (Va) | Partial voltage (Va) value | Determined result |
|---|---|---|---|
| 100 | | 1.09 | Mono cartridge |
| 200 | | 2.00 | Mono cartridge |
| 330 | | 2.98 | Mono cartridge |

If partial voltage (Va) detected by the above is digitized by analog/digital converter 110 and provided to a determining part in CPU 101, the determining part can determine the type of the cartridge corresponding to partial voltage Va stored by the cartridge. Therefore, the present invention having the simple construction can easily determine cartridge type.

While the present invention has been described with reference to particular illustrative embodiments, it is not intended to be restricted by the embodiments, but only by the appended claims. It is to be appreciated that those skilled in the art can change or modify the embodiments without departing from the scope and spirit of the present invention.

According to the present invention, the apparatus for determining the cartridge type of a printer using a micro injecting device has accomplished several advantageous objectives, as follows.

The contact structures of cartridge are given differently depending on the types of cartridge and contact-state sensing signal of the dimple part, which is the connection part between the cartridge and the cable, is detected depending on the contact structure of each cartridge, so that the cartridge type can be easily determined even in a simple construction of the apparatus.

The contact structures of cartridges are given differently depending on the type of cartridge, and a contact-state sensing signal of the dimple part, which is the connection part between the cartridge and the cable, is detected depending on the contact structure of each cartridge, so that the cartridge type can be easily determined, even in a simple construction of the apparatus.

Furthermore, the resistance values of the partial resistance mounted in the cartridges are given differently depending on the type of cartridge and the partial voltage, which has a different resistance value depending on the type of cartridge, mounted in each cartridge, and the voltage divided by the reference resistor value in the central processing unit, are detected so that the cartridge type can be easily determined, even in a simple construction of the apparatus.

Moreover, the cartridge type can be determined using the form of contact structure or the resistance inside the cartridge, so that this device has good durability and is low in manufacturing cost.

Although preferred embodiments of the present invention have been described, it will be understood by those skilled in the art that the present invention should not be limited to the described preferred embodiments. Rather, various changes and modifications can be made within the spirit and scope of the present invention, as defined by the following claims.

What is claimed is:

1. An apparatus for determining a cartridge type of a printer, the printer using a micro injecting device and accepting cartridges of various types, said apparatus comprising:

a central processing unit; and connection means for connecting the central processing unit to a cartridge, the connection means having at least two cartridge type sensing contact parts, the connection means being electrically connected to a contact structure of the cartridge, each type of cartridge having a different contact structure, said connection means providing an output signal corresponding to the type of the cartridge;

said central processing unit comprising means for detecting the output signal from the connection means, for comparing the detected output signal with a reference signal to obtain a comparison result, and for determining the type of the cartridge based on the comparison result.

2. The apparatus of claim 1, wherein the connection means includes a number of dimple parts corresponding to the contact structure of the cartridge.

3. The apparatus of claim 1, wherein the contact structure of the cartridge comprises a plurality of contact parts, one of the contact parts of the cartridge being electrically connected to at least one other contact part.

4. The apparatus of claim 1, wherein the cartridges are a mono cartridge of a single color, a color cartridge having two or more colors, and a photo cartridge.

5. The apparatus of claim 1, wherein the cartridges comprise a mono cartridge of a single color and a color cartridge having at least two colors.

6. An apparatus for determining a cartridge type of a printer, the printer using a micro injecting device and accepting cartridges of various types, said apparatus comprising:

connection means having at least two cartridge type sensing contact parts, the connection means being electrically connected to a cartridge different types of cartridges having different contact structures, said connection means providing an output signal corresponding to the type of the cartridge; and a central processing unit (CPU) for detecting the output signal from the connection means, for comparing the detected output signal with a reference signal to obtain a comparison result, and for determining the type of the cartridge based on the comparison result, the CPU comprising:

a constant voltage regulated power supply electrically connected to one of the contact parts to supply a predetermined constant voltage;

a pull-up resistance connected between the constant voltage regulated power supply and one of the contact parts, said resistance corresponding to the contact structure of the cartridge;

at least one contact signal input terminal electrically connected to remaining contact parts, other than the contact part connected to the pull-up resistance, in one-to-one relationship;

means for detecting that a power source provided from the constant voltage regulated power supply is supplied to at least one contact signal input terminal through the pull-up resistance corresponding to the contact structure of the cartridge; and means for determining the type of the cartridge according to a signal from the at least one contact signal input terminal.

7. An apparatus for determining a cartridge type of a printer, the printer using a micro injecting device and accepting cartridges of various types, said apparatus comprising:

a central processing unit having a constant voltage regulated power supply for supplying a predetermined constant voltage, and a reference resistor connected to the constant voltage regulated power supply, the reference resistor having a predetermined resistance value; and connection means for connecting to a cartridge, the cartridge having a partial resistance having a resistance value corresponding to a type of the cartridge, and a ground terminal connected to the partial resistance, the connection means electrically connecting in series the partial resistance of the cartridge and the reference resistor of the central processing unit;

whereby, when the cartridge and the central processing unit are electrically connected, the central processing unit detects a level of a partial voltage supplied from the constant voltage regulated power supply, divided by the partial resistance of the cartridge and the predetermined resistance value of the reference resistor of the central processing unit, compares the detected level of the partial voltage with at least one preset reference level value to provide a comparison result, and determines the type of the cartridge according to the comparison result.

8. The apparatus of claim 7, wherein the central processing unit further comprises an analog/digital converter for digitizing the level of the partial voltage divided by the partial resistance of the cartridge and the predetermined resistance value of the reference resistor of the central processing unit.

9. The apparatus of claim 7, wherein the cartridges comprise a mono cartridge of a single color, a color cartridge having at least two colors, and a photo cartridge.

10. The apparatus of claim 7, wherein the cartridges comprise a mono cartridge of a single color and a color cartridge having at least two colors.

11. A method for determining a cartridge type of a printer, the printer using a micro injecting device and accepting cartridges of various types, said method comprising the steps of:

(1) electrically connecting to at least two cartridges a connection unit which provides an output signal corresponding to a type of a cartridge via a cartridge-type sensing contact part, different types of cartridges having different contact structures corresponding thereto;

(2) detecting the output signal from the connection unit;

(3) comparing the detected output signal with a reference signal; and (4) determining the type of the cartridge on the basis of said comparing step.

12. A method for determining a cartridge type of a printer, the printer using a micro injecting device and accepting cartridges of various types, said method comprising the steps of:

(1) providing a central processing unit having a constant voltage regulated power supply for supplying a predetermined constant voltage, and a reference resistor connected to the constant voltage regulated power supply, the reference resistor having a predetermined resistance value;

(2) electrically connecting to a cartridge a connection unit, the cartridge having a partial resistance having a resistance value corresponding to a type of the cartridge, and a ground terminal connected to the partial resistance, the connection means electrically connecting in series the partial resistance of the cartridge and the reference resistor of the central processing unit;

(3) detecting a level of partial voltage supplied from the constant voltage regulated power supply, divided by the partial resistance of the cartridge and the predetermined resistance value of the reference resistor of the central processing unit;

(4) comparing the detected level of the partial voltage with at least one preset reference level value to provide a comparison result; and (5) determining the type of the cartridge according to the comparison result.

13. An apparatus for determining a cartridge type of a printer, the printer using a micro injecting device and accepting cartridges of various types, said cartridges comprising a mono cartridge of a single color and a color cartridge having at least two colors, said apparatus comprising:

a central processing unit having a constant voltage regulated power supply for supplying a predetermined constant voltages, and a reference resistor connected to the constant voltage regulated power supply, the reference resistor having a predetermined resistance value; and connection means for connecting to a cartridge, the cartridge having a partial resistance having a resistance value corresponding to a type of the cartridge, and a ground terminal connected to the partial resistance, the connection means electrically connecting in series the partial resistance of the cartridge and the reference resistor of the central processing unit;

whereby, when the cartridge and the central processing unit are electrically connected, the central processing unit;

detects a level of partial voltage, supplied from the constant voltage regulated power supply, divided by the partial resistance of the cartridge and the predetermined resistance value of the reference resistor of the central processing unit;

compares the detected level of the partial voltage with at least one preset reference level value to provide a comparison result; and determines the type of the cartridge according to the comparison result.

* * * * *